US005233708A

United States Patent [19]

Winston, Sr.

[11] Patent Number: 5,233,708

[45] Date of Patent: * Aug. 10, 1993

[54] PATIENT TRANSFER APPARATUS

[75] Inventor: Alexander G. Winston, Sr., Oxford, N.C.

[73] Assignee: Cindylift Products, Inc., Henderson, N.C.

[ * ] Notice: The portion of the term of this patent subsequent to Mar. 10, 2009 has been disclaimed.

[21] Appl. No.: 922,633

[22] Filed: Jul. 30, 1992

[51] Int. Cl.[5] ..... A61G 7/10; A61G 7/14

[52] U.S. Cl. ..... 5/81.1; 280/47.33; 280/47.25; 414/490

[58] Field of Search ..... 5/81.1, 86.1, 625, 628; 280/47.25, 304.1, 32.5, 47.33; 414/490, 921

[56] References Cited

U.S. PATENT DOCUMENTS

| | | | |
|---|---|---|---|
| 2,607,050 | 8/1952 | Binschoff | 5/81.1 |
| 2,668,721 | 2/1954 | Wright | 280/47.33 |
| 2,990,190 | 6/1961 | Eriksen | 280/47.33 |
| 4,435,863 | 3/1984 | Lerich | 5/81.1 |
| 4,510,633 | 4/1985 | Thorne | 5/81.1 |
| 5,093,944 | 3/1992 | Winston, Sr. | 5/81.1 |

*Primary Examiner*—Alexander Grosz
*Attorney, Agent, or Firm*—Richard E. Jenkins

[57] ABSTRACT

A mobile patient lift and transport apparatus for lifting and moving an incapacitated or partially incapacitated person from one location to another in a substantially forwardly leaning and supported position. The apparatus is provided with an elongate frame which pivots about the single rotational axis defined by the wheels thereof in order to facilitate lifting and transportation. Foot rest means, leg support means, and a vertically elevated trunk support means are provided to support the weight of the person being carried in the forwardly leaning position with his center of gravity positioned substantially over the rotational axis of the wheels. The apparatus also includes a support stand pivotably mounted to the frame and movable from a normally inoperative position adjacent the frame to an operative position depending downwardly from the frame.

10 Claims, 7 Drawing Sheets

PATIENT TRANSFER APPARATUS

DESCRIPTION

1. Technical Field

The present invention relates to patient transfer apparatus and more particularly to a device for moving incapacitated and partially incapacitated persons from one location to another.

2. Related Art

It has long been a problem to move incapacitated or partially incapacitated persons from one location to another in hospitals, nursing homes as well as in the patient's residence. Particularly, it is difficult to move a person from a sitting position in a bed to a wheelchair, commode or the like at another location. One attempted solution is for one or more other persons to carry the incapacitated or partially incapacitated person from the bed to the other desired location. This, of course, is labor intensive and not possible in many circumstances.

Another solution to the problem of transporting disabled persons from one location to another location is to utilize manually actuated or powered lifting devices to transfer incapacitated and partially incapacitated persons. Unfortunately, as is well known to those familiar with these devices, the mechanical transfer apparatus suffer a wide variety of shortcomings. In addition to being prohibitively expensive, most are large and unwieldy. The mechanical transfer apparatus have been found to be particularly ill-suited for use in moving a disabled person who resides in a conventional residential home.

The device disclosed in U.S. Pat. No. 4,157,593 to Kristensson is representative of mechanical invalid transfer apparatus. The patent discloses a patient lift and transport apparatus adapted to lift the patient from a sitting position in a chair or bed and transport the patient to a desired location where the patient is again placed in a sitting position. The apparatus comprises a frame mounted on four wheels and provides both a knee and chest support so that the incapacitated person can be transported in an upright, forwardly inclined position. A U-shaped belt is secured under the buttocks of the patient to lift the patient toward the apparatus, and the belt is secured to the sides of the apparatus in order to secure the patient in a forwardly inclined transporting position.

Also, U.S. Pat. No. 4,510,633 to Thorne discloses an invalid transfer apparatus for moving persons from one location to another without requiring a great amount of effort. The apparatus comprises a four wheel carriage having a pivotably movable upstanding frame which moves from a vertical to an inclined position to facilitate lifting a person from a sitting position with a flexible seat passed under his buttocks and then pivoting the person forwardly into a forwardly leaning position wherein his center of gravity is over the four wheel carriage. The pivotable frame carries padded knee supports, a padded chest support, padded arm supports and a foot rest to facilitate the comfort of the person while being transported in the inclined position on the transfer apparatus. The device is intended to enable a single nurse or other individual to place the person onto the device and move the person to another location without assistance and without excessive effort.

Other patents of possible interest relating generally to invalid transfer apparatus include U.S. Pat. No. 2,963,713 to Forrest; U.S. Pat. No. 2,975,435 to Forrest; U.S. Pat. No. 3,041,636 to Twedt; and U.S. Pat. No, 4,934,003 to Hayakawa et al.

DISCLOSURE OF THE INVENTION

In accordance with the present invention, applicant provides a mobile patient lift and transport apparatus for moving an incapacitated or partially incapacitated person from one location to another in a substantially forwardly and downwardly leaning position. The apparatus comprises an elongate frame having a top and a bottom end and at least two wheels mounted adjacent the bottom end thereof so as to define a single rotational axis therebetween, and the frame is pivotable about the rotational axis through an angle of about 0° to 90° to the horizontal. A foot rest extends outwardly from the bottom end of the frame, and leg support means are mounted to the frame substantially between the medial portion and the bottom end thereof for supporting the feet as well as the knees and legs, respectively, of a patient being transported. Vertically elevated trunk support means are mounted to the frame substantially between the medial portion and the top end thereof for supporting the trunk of a patient being transported, and handle means are provided adjacent the top end of the frame to facilitate maneuvering of the apparatus by the person or persons assisting in the transportation of the patient.

Thus, an incapacitated or partially incapacitated person may be engaged by the apparatus while in the sitting position and the apparatus pivoted about the axis of its at least two wheels so as to place the person being transported in an inclined, forwardly leaning position wherein his center of gravity is located approximately over the axis of the wheels for ease of transport.

It is therefore the object of this invention to provide a relatively inexpensive and easily usable apparatus for moving incapacitated and partially incapacitated persons from one location to another.

Another object of the invention is to provide an apparatus for moving an incapacitated or partially incapacitated person from one location to another wherein the patient is maintained in a comfortable, forwardly inclined position so as to primarily rest on his trunk area in a natural, comfortable position.

Another object of the invention is to provide an apparatus for transporting an incapacitated or partially incapacitated person from one location to another in a forwardly inclined position wherein the person's lower body can be easily exposed for the performance of necessary hygiene-related activities.

It is yet another object of the invention to provide an apparatus for moving incapacitated or partially incapacitated persons from one place to another wherein the person is positioned in a forwardly inclined position with his center of gravity substantially over the rotational axis of the wheels and wherein the person is transported substantially horizontally at an angle typically between about 30°–40° from the horizontal to minimize transport effort as well as maximize the comfort of the person being transported.

It is yet another object of the invention to provide an apparatus for transporting incapacitated or partially incapacitated persons from one location to another wherein a person of small stature and/or limited strength can easily maneuver the apparatus to lift the incapacitated person from a sitting position, pivot the person to the forwardly inclined transport position, transport the person to the desired location, and return the incapacitated person to a sitting position.

Some of the objects of the invention having been stated, other objects will become evident as the description proceeds, when taken in connection with the accompanying drawings which are merely illustrative of the present invention.

BEST MODE FOR CARRYING OUT THE INVENTION

Figure 1:
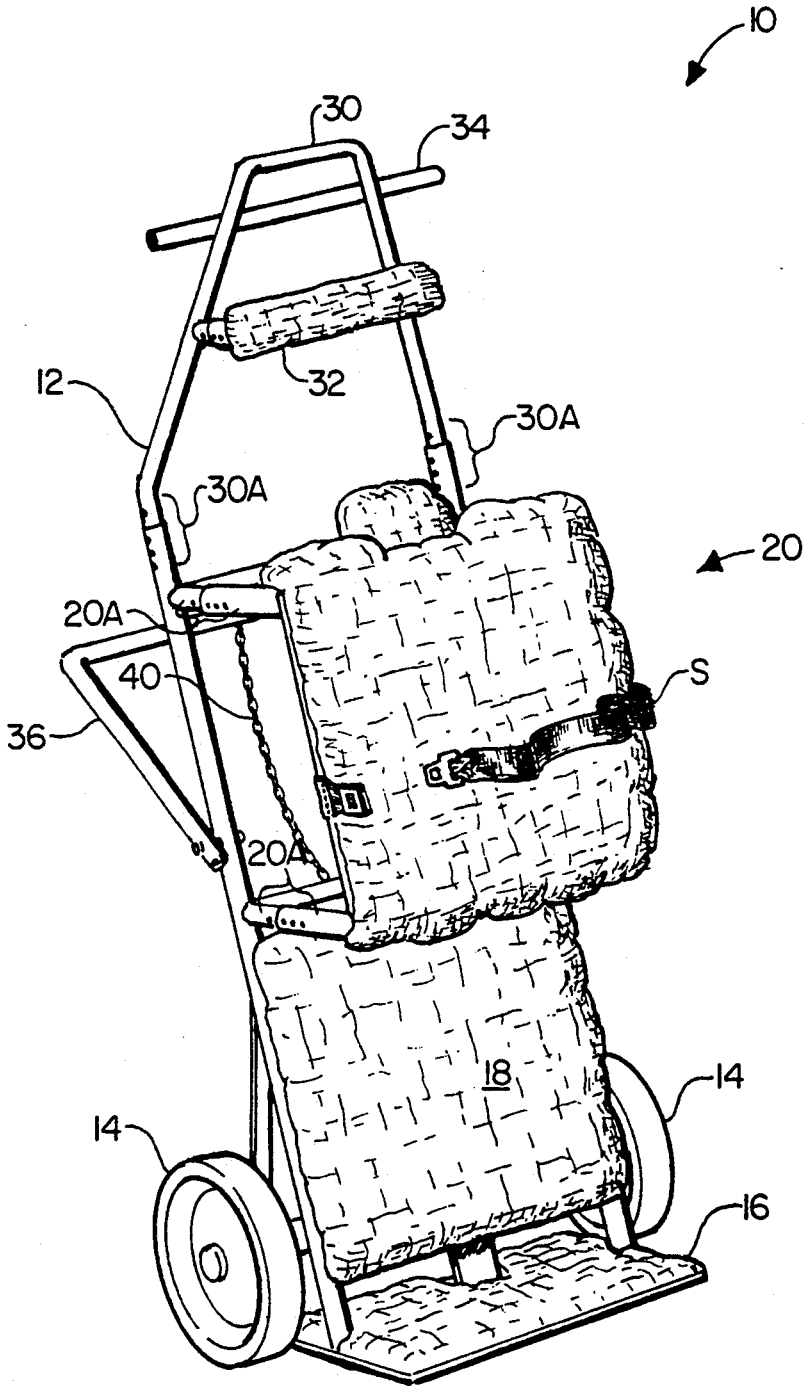
FIG. 1 is a perspective view of the apparatus according to the invention.
Figure 2:
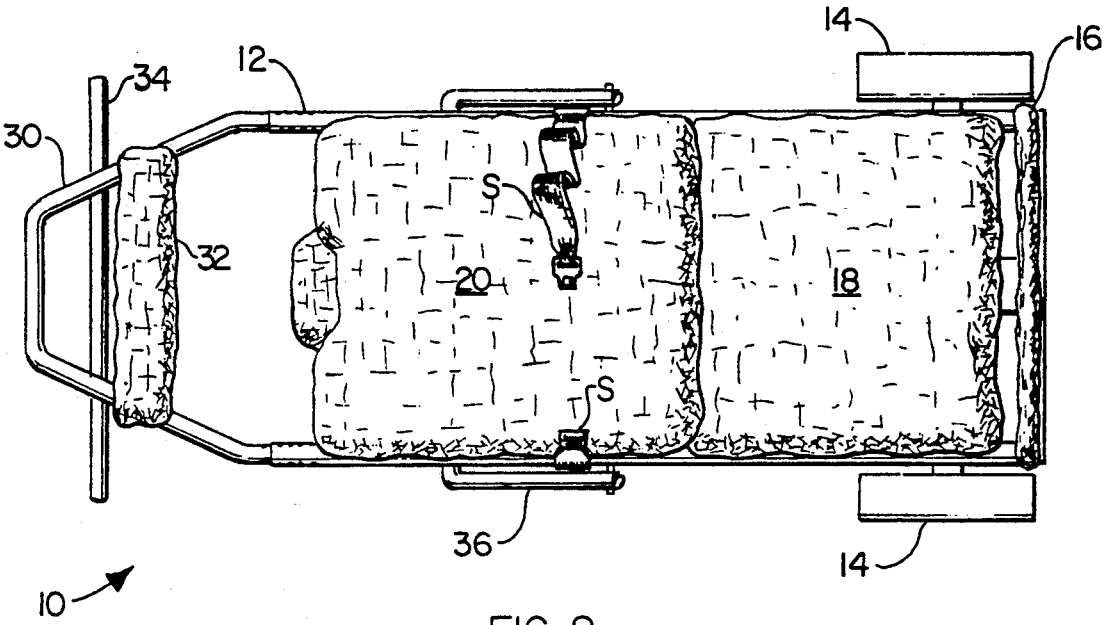
FIG. 2 is a top plan view of the apparatus according to the invention.
Figure 3:
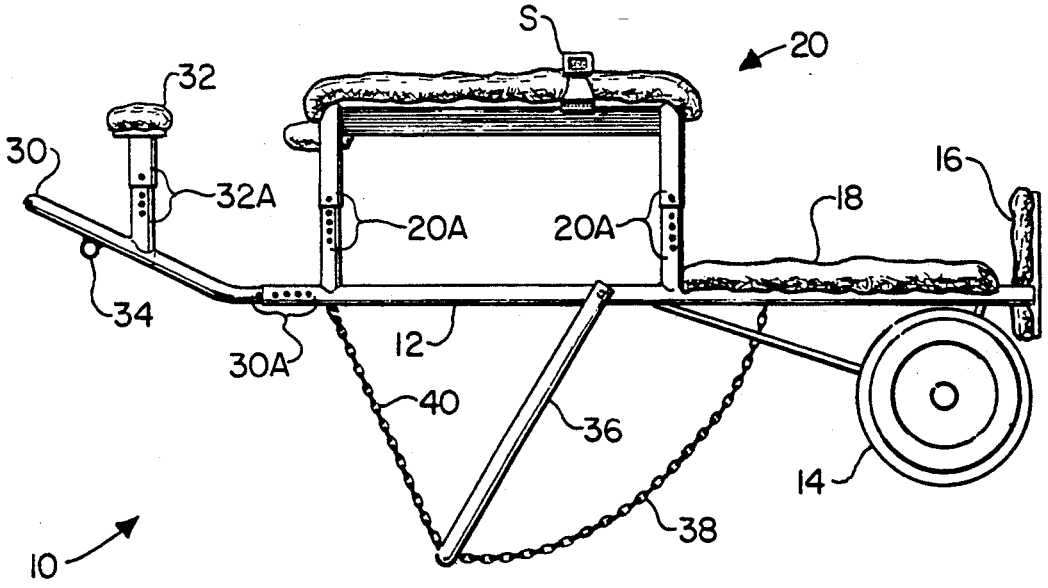
FIG. 3 is a side elevation view of the apparatus according to the invention.

Referring now to FIGS. 1-3 of the drawings, the patient transfer apparatus of the present invention is indicated generally at 10. Apparatus 10 comprises a frame 12 having wheels 14 (preferably having a diameter between 6-10 inches) rotatably mounted thereon so that the rotational axis of each wheel 14 is Coaxial with the other wheel and allows frame 12 to pivot about the single rotational axis defined by wheels 14 from (1) an upright position substantially normal to the ground to (2) a lowered position substantially parallel to the ground (or through an angle of about 90° to 0° to the horizontal). A foot rest 16, preferably padded, extends outwardly from frame 12, and a knee and leg support 18, also preferably padded, is secured to the bottom portion of frame 12. Foot rest 16 serves to support the feet of a patient being transported, and knee and leg support 18 serves to support the knees and legs of the aforesaid patient.

A trunk support, generally designated 20, is provided on the upper portion of frame 12 to support the trunk portion (e.g., chest and abdomen) of a patient being transported, and trunk support 20 is most suitably well-padded for comfort. Applicant has found that trunk support 20 most suitably is elevated about 10-20 inches above frame 12, and defines a width of about 15-20 inches and a length of about 10-20 inches. Even more desirably, trunk support 20 has a height between about 12-16 inches, a width of about 16-18 inches and a length of about 15-20 inches. Trunk support 20 is provided with vertical adjustability by any suitable conventional vertical adjustment mechanism 20A. For example, the support legs for trunk support 20 may be adapted for telescopic movement by each leg being provided with apertures in the pair of telescoping sections thereof so that the telescoping sections may be suitably adjusted and locked by means of an internal spring locking clip or the like (not shown)

An upturned handle 30 is provided for lifting and maneuvering transport apparatus 10. Handle 30 has head support 32 secured thereto for supporting the head of a patient being transported by transport apparatus 10. Head support 32 may be vertically adjusted by any suitable conventional vertical adjustment mechanism 32A such as utilized to provide vertical adjustability to trunk support 20. Also, a hand grip 34 is secured to the underside of handle 30 in order to provide greater security to a patient being transported on apparatus 10. Most suitably, handle 30 is slidably adjustable relative to frame 12 by any conventional adjustment mechanism 30A such as utilized for headrest 32 and trunk support 20. Thus, handle 30 may be extended or withdrawn relative to frame 12 in accordance with the strength and stature of the individual who will lift and transport the incapacitated or partially incapacitated person on transport apparatus 10.

A belt or strap S is attached to each side of trunk support 20 to secure the patient being transported immediately above the waist for safety. However, the preponderance of the weight of the patient is supported by foot rest 16, knee and leg support 18 and trunk support 20, and strap S is merely used to prevent the patient from slipping downwardly toward the bottom end of transport apparatus 10. Finally, and very importantly, a U-shaped support 36 is pivotably mounted at each end to frame 12.

Support 36 would normally be retained in a collapsed position adjacent the bottom end of frame 12 when apparatus 10 is stored. When transport apparatus 10 is prepared for use, support 36 is pivoted outwardly so as to support frame 12 when it is desired to rest transport apparatus 10 and the patient thereon in a stationary position on the transport surface. A first restraint chain 38 is secured at one end to support 36 and at the other end to frame 12 in order to prevent support 36 from collapsing upwardly toward the upper end of frame 12 when in use. A second restraint chain 40 which is secured at one end to support 36 is releasably connected by a clamp or the like at the other end to frame 12 in order to prevent support 36 from pivoting downwardly toward the bottom end of support frame 12 when transport apparatus 10 is being utilized to transport a patient. When apparatus 10 is not in use and/or in storage, second restraint chain 40 is unhooked from frame 12 and support 36 is pivoted downwardly into its inoperative position adjacent the lower end of frame 12.

Figure 4:
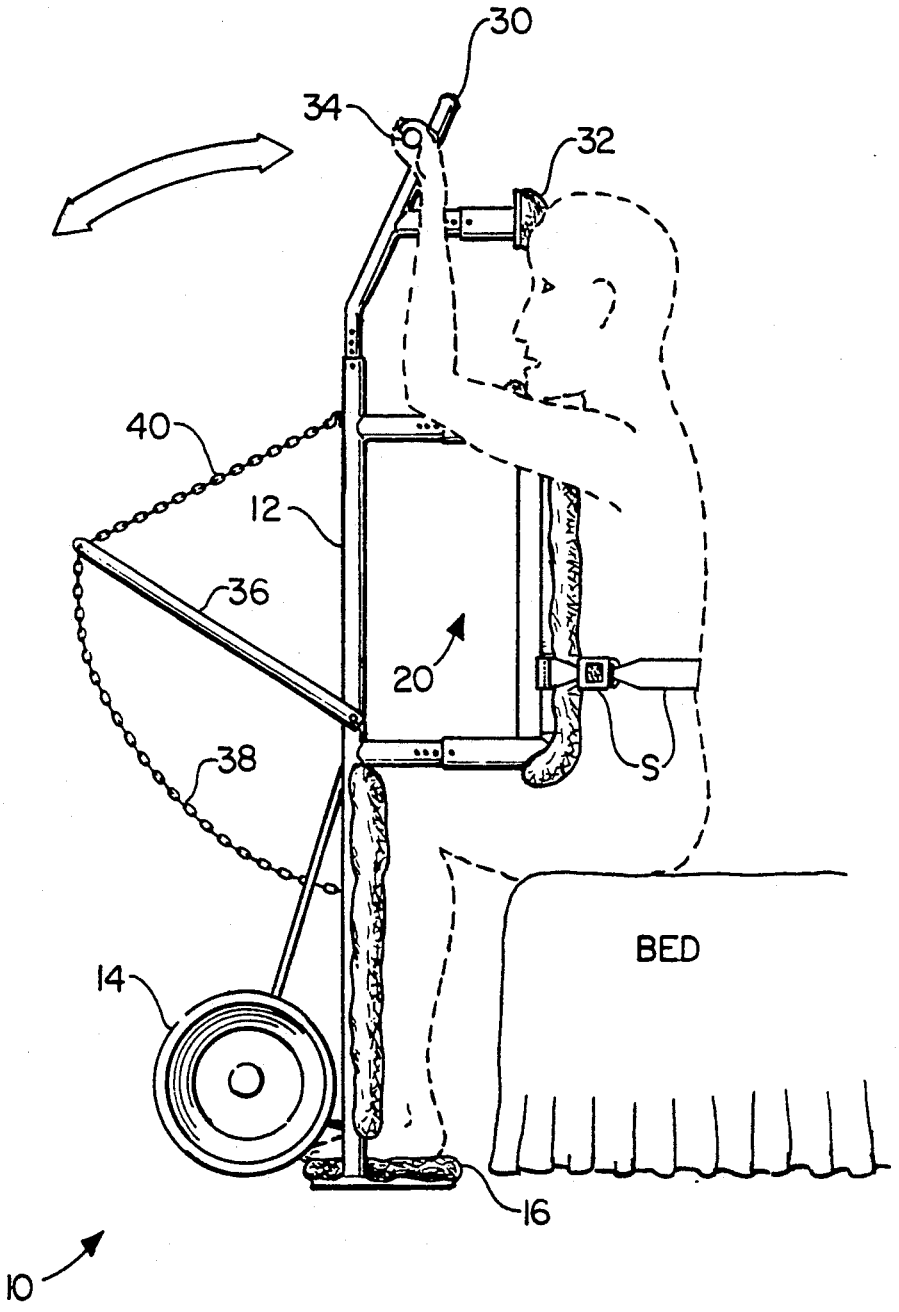
FIG. 4 is a side elevation view of the apparatus according to the invention positioned in the upright position for engaging a sitting person to be transported.
Figure 5:
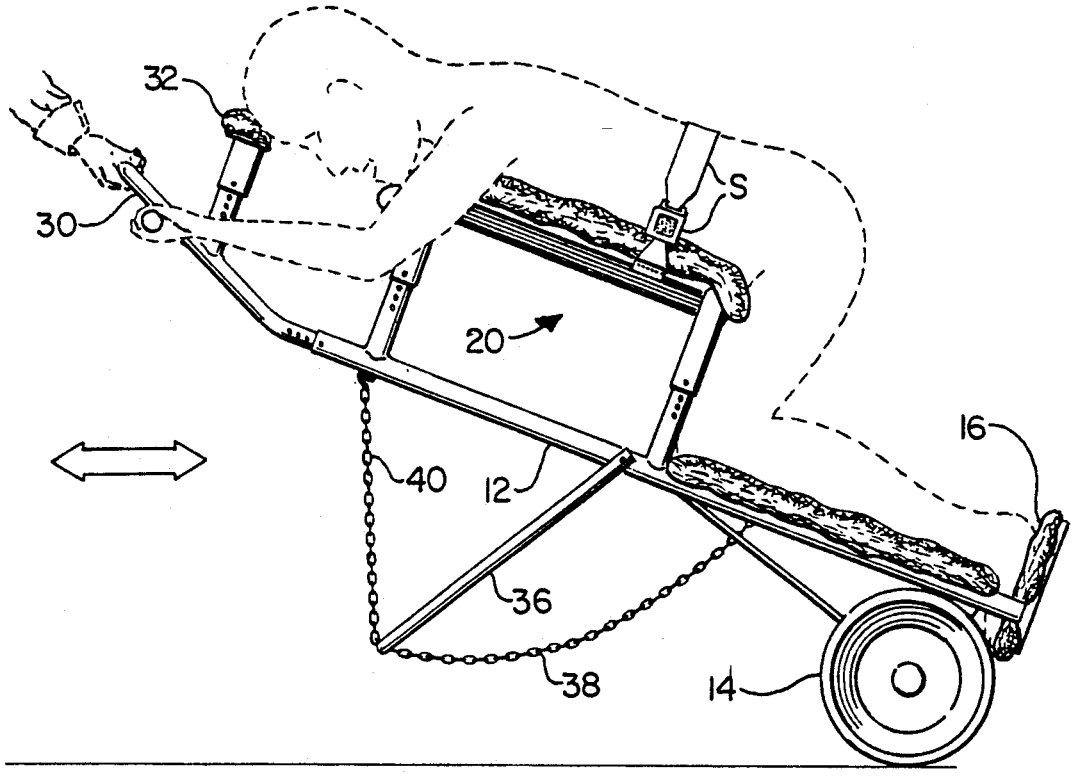
FIG. 5 is a side elevation view of the apparatus having been pivoted to a generally horizontal position so as to transport a person thereon in a forwardly inclined and supported position.
Figure 6:
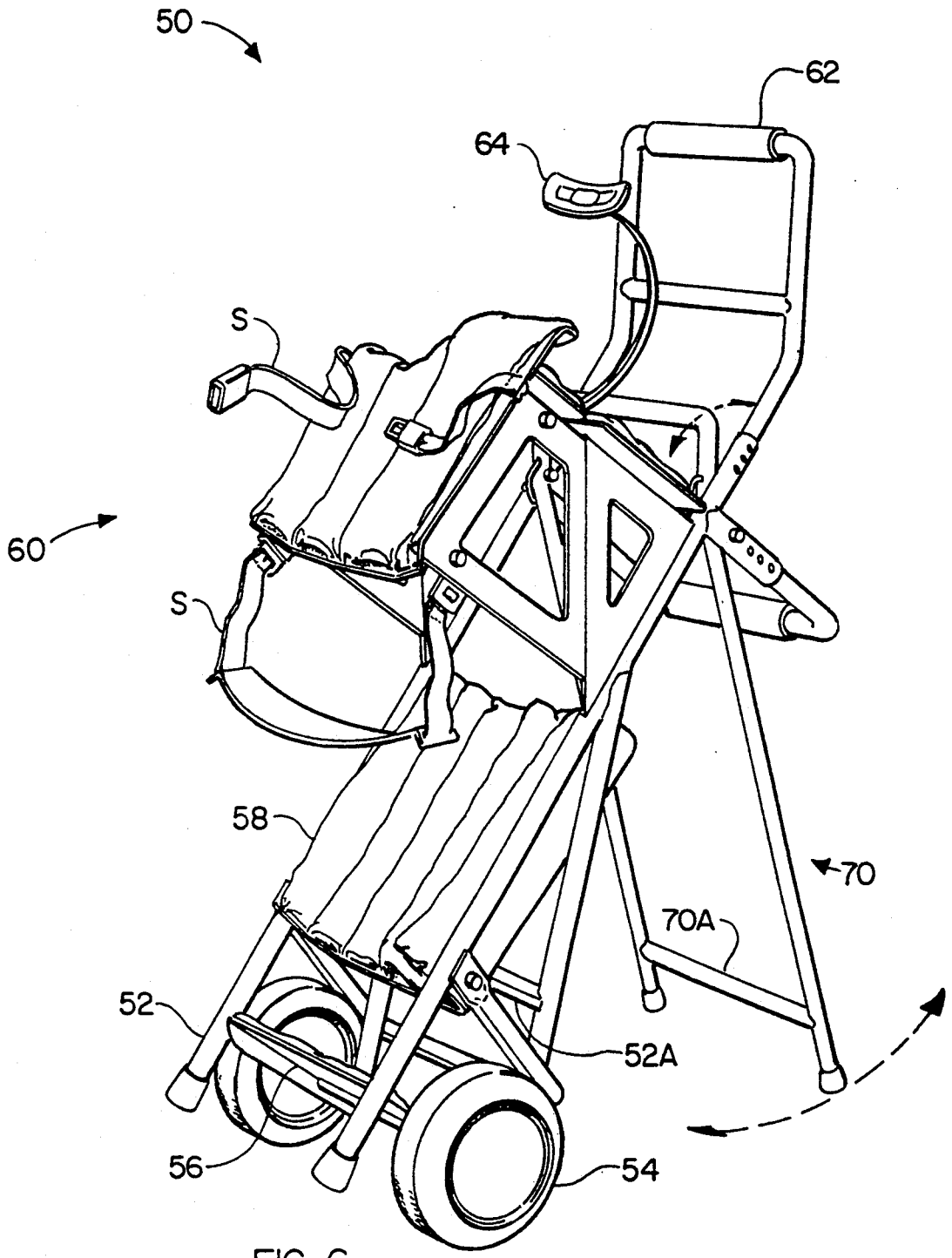
FIG. 6 is a perspective view of a second embodiment of the apparatus according to the invention.

In use, and With particular reference to FIGS. 4 and 5, it can be appreciated that transport apparatus 10 is first pushed over to a person in a sitting position on a bed, chair, commode or the like. The feet of the incapacitated or partially incapacitated person are placed on foot rest 16, the person is leaned forwardly with his knees pressed against knee and leg support 18, and his entire body trunk is urged against trunk support 20. Transport apparatus 10 is then pivoted from the upright position to a substantially horizontal position wherein the person on transport apparatus 10 is in a forwardly leaning position and substantially entirely supported by apparatus 10. Belt S is secured to the person just above his waist for safety and to prevent him from slipping downwardly toward the bottom end of apparatus 10. The person is then transported to another location where the process is reversed in order to place the person in a sitting position at the new location. Preferably, transport apparatus 10 is carried at an angle of about 30°-40° to the horizontal although any angle in the range of between about 15°-80° to the horizontal is possible. If desired, transport apparatus 10 may be rested on support 36 while being moved from one location to another.

Also, and very importantly, apparatus 10 does not obstruct the lower portion of the body of the person being transported so that it is a simple matter to remove the lower clothes of the person while apparatus 10 is in the resting position supported by support 36. The lack of obstruction of the lower body of the person being transported is convenient for hygiene purposes since the entire back and buttocks can be exposed for cleansing. Also, suitable medicants can be applied to bed sores on the back and buttocks, and heat lamps can be used to help heal the bed sores. This ease of performing personal hygiene on the person being transported is not believed by applicant to be found in any of the presently known lifting and transporting devices.

Alternative Embodiment of Patient Transfer Apparatus

Referring now to FIGS. 6-10 of the drawings, an alternative embodiment of the patient transfer apparatus is indicated generally at 50. Apparatus 50, similarly to apparatus 10 described hereinbefore, comprises a frame 52 having wheels 54 rotatably mounted thereon so that the rotational axis of each wheel 54 is coaxial with the other wheel and allows frame 52 to pivot about the single rotational axis defined by the wheels. A foot rest 56 is carried by frame 52, and a knee and leg support 58 is also secured to frame 52. A trunk support, generally designated 60, is provided on the upper portion of frame 52 to support the trunk portion (e.g., chest and abdomen) of a patient being transported on apparatus 50.

Also, as described in the first embodiment of the invention, an upturned handle 62 is provided for lifting and maneuvering apparatus 50, and a head support 64 is provided for supporting the head of the patient during transportation on apparatus 50. A suitable pair of straps or belts S are attached to each side of trunk support 50 to secure a patient to apparatus 50 although the preponderance of the weight of the patient is supported by foot rest 56, knee and leg support 58 and trunk support 60. Still referring to FIGS. 6-10, it can be seen that apparatus 50 also includes a support stand 70 which is pivotably mounted to frame 52 so as to move from a first inoperative position (see FIG. 7) to a second operative position (see FIG. 8). Support stand 70 is pivotably secured to frame 52 at each side thereof by conventional bolt, washer and screw assembly 72A-72C, respectively, (see FIG. 9) and support stand 70 is urged into a normally inoperative position against frame 52 by torsion spring 74 provided at each of the two opposing pivotal axes where support stand 70 is mounted to frame 52. Torsion spring 74 is conventional and secured at one end to frame 52 and at the other end to support stand 70 so as to urge the support stand upwardly against frame 52 (see FIG. 9).

Figure 10:
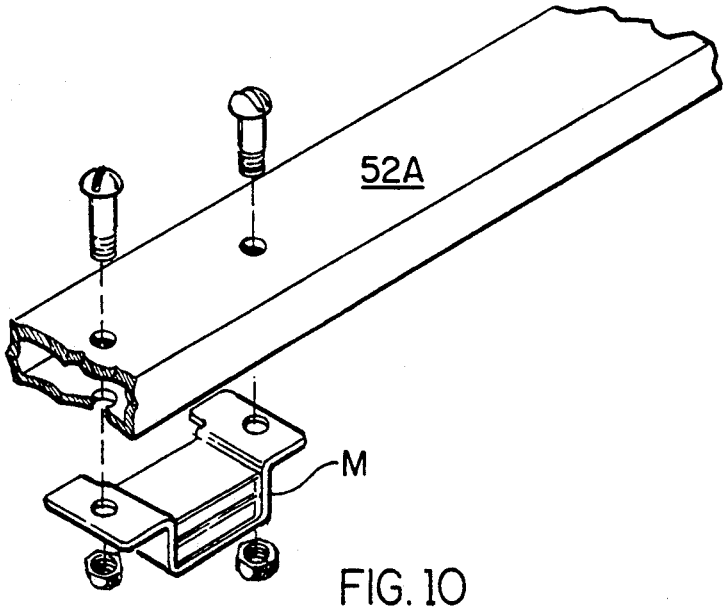
FIG. 10 is an enlarged and exploded fragmentary view of the magnet mounted to the apparatus frame for retaining the support stand in the retracted position

As can best be seen in FIG. 10, a magnet is secured to cross bar 52A of frame 52 which acts to releasably engage the corresponding cross bar 70A of support stand 70 when the support stand is urged into its inoperative position.

The specifics of support stand 70 and the operation thereof are set forth below in greater detail so as to provide a better appreciation of the significance of this feature which is not provided in the first embodiment of the invention described hereinbefore.

Support stand 70 is an attachment that is designed to enable apparatus 50 to support a person at approximately a 40°-50° angle with no physical assistance required from the operator. Stand 70 consists of a shaped or formed section of metal tubing or similar material that attaches to and pivots relative to frame 52. Support stand 70 utilizes torsion spring 74 to draw it to frame 52 whenever the weight of apparatus 50 is not resting on support stand 70.

Support stand 70 is held to frame 52 by means of magnet M (or any other suitable type of releasable latching device) that is strong enough to support the weight of stand 70 but weak enough to be easily released. Magnet M automatically engages when support 70 comes into near contact with frame 52 of patient transfer apparatus 50. Stand 70 most suitably has a rubber or similar material bumper (not shown) that keeps it from colliding with frame 52 in a noisy or damaging manner.

Optionally, support stand 70 may also be equipped with suitable rollers (not shown) that would enable apparatus 50 to roll a short distance either forward or backward while stand 70 is in use. Stand 70 could also be provided with swivel wheels (not shown) and a locking mechanism (not shown) to enable apparatus 50 to be moved like a 4-wheeled stretcher when stand 70 is fully extended.

Operation of Support Stand

Figure 8:
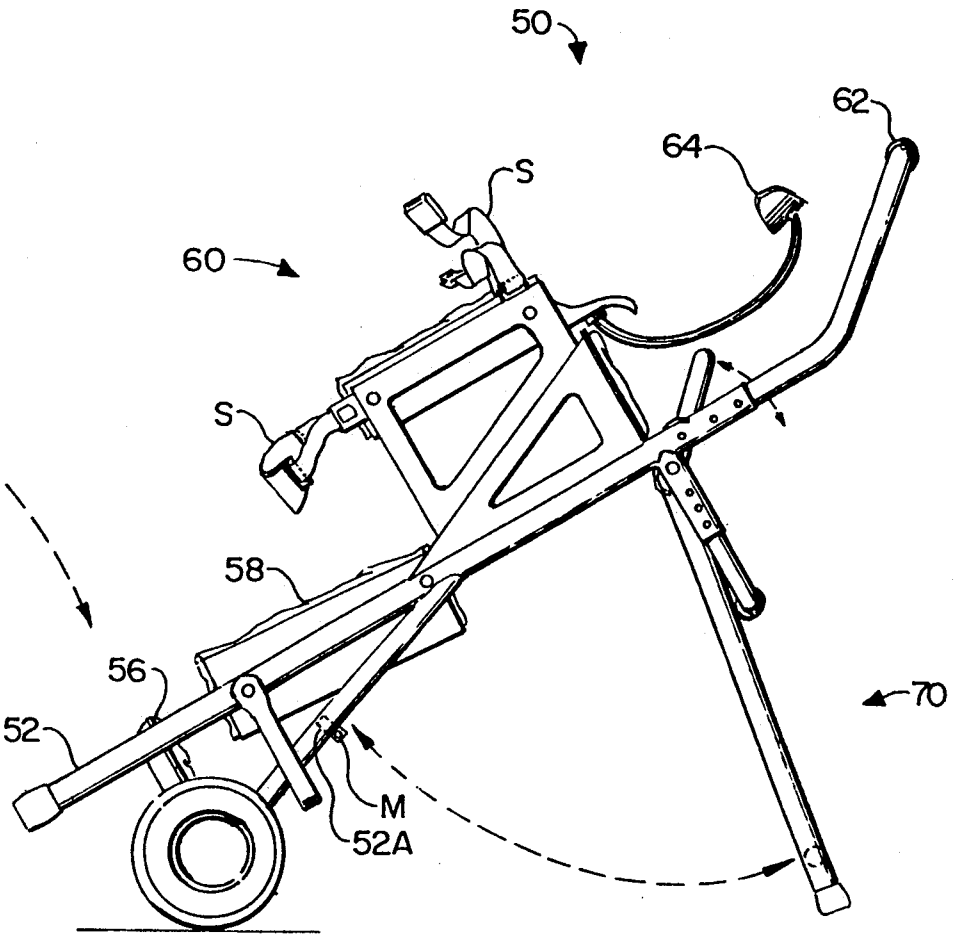
FIG. 8 is a side elevation view of the apparatus of FIG. 6 with the support stand thereof in the extended position.
Figure 7:
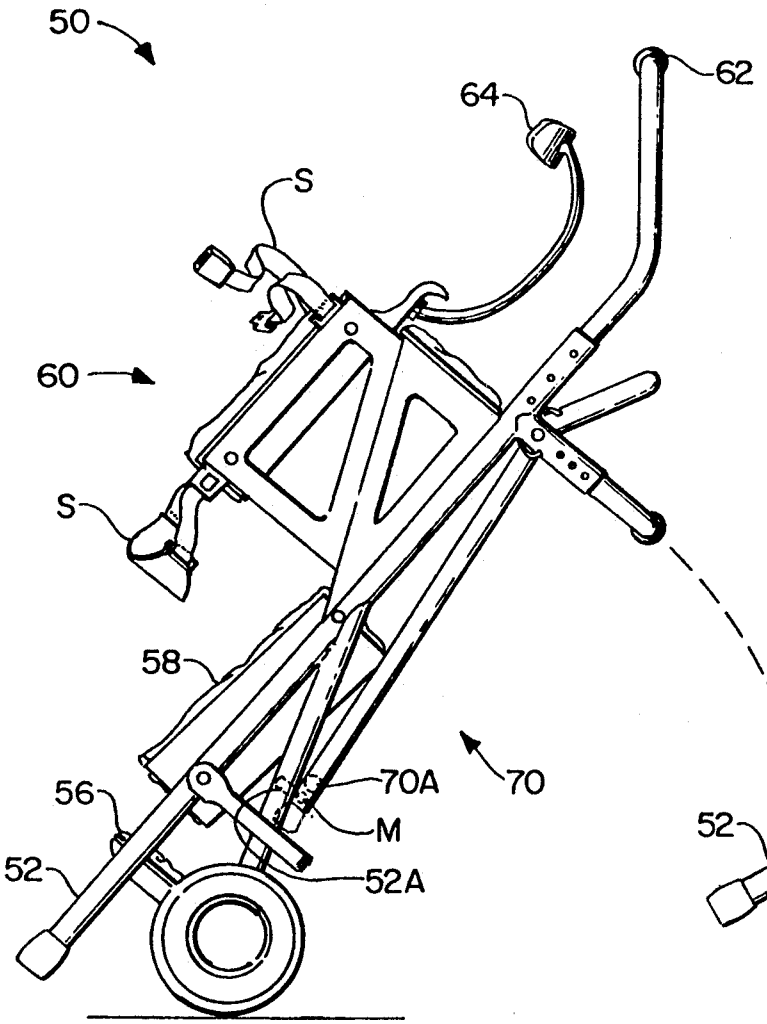
FIG. 7 is a side elevation view of the apparatus of FIG. 6 with the support stand thereof in the retracted position.
Figure 9:
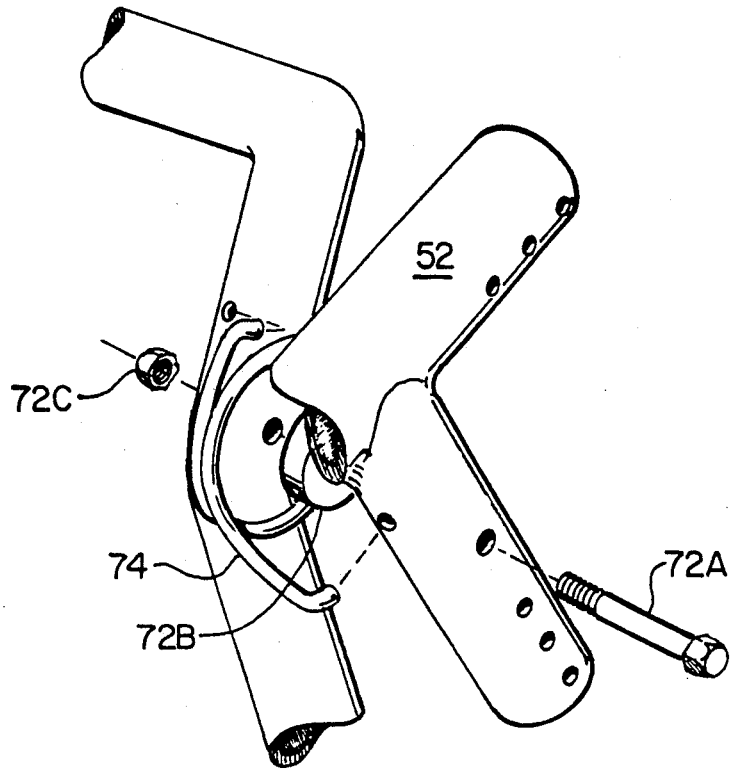
FIG. 9 is an enlarged and exploded fragmentary view of the pivotable joint formed by the support stand and the apparatus frame.

When not in use, stand 70 is automatically secured to frame 52 by magnet M. Stand 70 is engaged by the attendant or patient by grasping the upper handle and moving it toward the patient. This causes the stand to be released from magnet M and to extend as shown in FIG. 8 of the drawings until it reaches its full extension. When stand 70 is fully extended (see FIG. 8), the attendant may pivot apparatus 50 downwardly until the weight of the apparatus is fully supported by stand 70. It is now safe to release the grip thereon and stand 70 will fully support the weight of the patient.

In order to disengage stand 70, the operator places both hands on handle 62 and slowly lifts apparatus 50 to the desired balance point. Stand 70 will automatically swing towards frame 52 and will be engaged by magnet M. The operator may now proceed to the desired destination.

Features and Benefits of Support Stand

Support stand 70 provides the following features and benefits to apparatus 50:

Feature 1 - When engaged, the stand will support a person in a forwardly leaning position where his weight is still primarily supported on his trunk and legs, but the patient is not in a fully horizontal position.

Benefits - More comfortable for the patient for a temporary stop where hygiene is not needed at the rear area of the patient. The more upright position gives the patient a greater sense of control or well-being. More dignified position for patient than full horizontal position, and less strength is required on attendant's part to lift and continue to move the patient (less risk of back injury to attendant).

Feature 2 - The stand, when not in use is held to the frame by means of a magnet or other temporary locking device. The stand is held against the frame.

Benefits - The stand does not interfere with the practical use of the lift.

Feature 3 - The magnetic or temporary locking device is strong enough to hold the weight of the stand, but weak enough to be released by one hand, or finger, or foot of the attendant, or by the patient.

Benefits - This makes it safer to use than if it had to be mechanically engaged. A more complex or difficult means of release could cause the attendant to lose his balance or slip or lose his grip on the apparatus.

Feature 4 - The stand has a spring mechanism that assists in urging the stand toward the frame. When the stand is being use and the operator pivots the apparatus up to move to another location, the stand automatically moves toward and attaches to the frame.

Benefits - This feature enables the attendant to lift the patient with both hands safely on the handle. The stand will swing up and out of the way, and the operator will not trip over the stand. When the stand is released from its latch, it does not swing into the fully extended position at a high speed, which could cause it to hit the leg of the attendant. The fact that the stand must be engaged by the operator with positive assistance makes it less likely that the operator will release his grip on the apparatus before the stand is fully extended since it requires the operator's attention and concentration.

It will be understood that various details of the invention may be changed without departing from the scope of the invention. Furthermore, the foregoing description is for the purpose of illustration only, and not for the purpose of limitation—the invention being defined by the claims.

What is claimed is:

1. A mobile patient lift and transport apparatus for moving an incapacitated or partially incapacitated person from one location to another in a substantially forwardly and downwardly leaning position, said apparatus comprising:

an elongate frame having a top and bottom end and further having at least two wheels mounted adjacent the bottom end thereof so as to define a single rotational axis therebetween, said frame being pivotable about said axis through an angle of about 0°-90° to the horizontal;

means for supporting the entire weight of a patient in a forwardly and downwardly leaning position and for exposing their buttocks for hygiene related purposes, said means comprising:

foot rest means extending outwardly from the bottom end of said frame for supporting the feet of a patient being transported;

leg support means mounted to said frame substantially between a medial portion and the bottom end thereof for supporting the knees and legs of a patient being transported;

trunk support means defining a trunk support surface which is vertically raised and spaced apart from a plane generally defined by said elongated frame mounted to said frame substantially between the medial portion and the top end thereof for supporting the upper and lower torso of a patient being transported;

handle means adjacent the top end of said frame for maneuvering said apparatus; and support stand means pivotably mounted to said frame for supporting said apparatus in a generally upstanding orientation at an angle between about 40°-50° to the horizontal, said support stand means being adapted to pivotably move from an inoperative first position adjacent said elongate frame to a downwardly depending operative second position extending outwardly from said frame, and said support stand means comprising biasing means to urge said support stand means from said second position towards said first position and retention means affixed to said elongate frame to releasably retain said support stand means in said first position.

2. An apparatus as in claim 1 including a head support mounted to said apparatus forwardly and spaced-apart from said trunk support means.

3. An apparatus as in claim 1 including strap means for securing the trunk of a patient being transported to said trunk support means.

4. An apparatus as in claim 1 wherein said frame has two wheels rotatably mounted adjacent one end thereof having a diameter between about 6-10 inches.

5. An apparatus as in claim 1 wherein said foot rest means, leg support means and trunk support means are padded.

6. An apparatus as in claim 1 wherein said trunk support means defines a width between about 15-20 inches, a length between about 10-20 inches, and a height between about 10-20 inches.

7. An apparatus as in claim 6 wherein said trunk support means is vertically adjustable.

8. An apparatus as in claim 1 wherein said handle means is adjustable relative to said frame.

9. An apparatus as in claim 1 wherein the biasing means of said support stand means comprises a torsion spring.

10. An apparatus as in claim 1 wherein the retention means of said support stand means comprises a magnet.

* * * * *